US008830130B2

(12) United States Patent
Tseng

(10) Patent No.: US 8,830,130 B2
(45) Date of Patent: Sep. 9, 2014

(54) FOLDABLE ELECTRONIC DEVICE

(75) Inventor: Kuan-Hsueh Tseng, Hsinchu (TW)

(73) Assignee: Wistron NeWeb Corporation, Hsinchu Science Park, Hsinchu (TW)

( * ) Notice: Subject to any disclaimer, the term of this patent is extended or adjusted under 35 U.S.C. 154(b) by 187 days.

(21) Appl. No.: 13/565,754

(22) Filed: Aug. 2, 2012

(65) Prior Publication Data

US 2013/0249743 A1 Sep. 26, 2013

(30) Foreign Application Priority Data

Mar. 23, 2012 (TW) ..... 101205344 U

(51) Int. Cl.
*H01Q 1/24* (2006.01)

(52) U.S. Cl.
CPC ..... *H01Q 1/243* (2013.01)
USPC ..... 343/702

(58) Field of Classification Search
CPC ..... H01Q 1/243; H01Q 21/28
USPC ..... 343/702, 893
See application file for complete search history.

(56) References Cited

U.S. PATENT DOCUMENTS

| | | | | |
|---|---|---|---|---|
| 7,301,499 | B2 * | 11/2007 | Shin et al. | 343/700 MS |
| 7,733,276 | B2 * | 6/2010 | Levy et al. | 343/702 |
| 8,400,362 | B2 * | 3/2013 | Watanabe | 343/702 |
| 2011/0254743 | A1 * | 10/2011 | Kobayashi et al. | 343/702 |

* cited by examiner

*Primary Examiner* — Hoang V Nguyen
(74) *Attorney, Agent, or Firm* — Winston Hsu; Scott Margo

(57) ABSTRACT

A foldable electronic device includes a flat panel display, a base and at least one antenna set. The flat panel display has a metal housing. The base has a pivot side, and the metal housing is pivoted to the pivot side. The antenna set is disposed in the base, and each antenna set has a main antenna and at least one auxiliary antenna, in which the main antenna and the auxiliary antenna are staggered.

11 Claims, 9 Drawing Sheets

FOLDABLE ELECTRONIC DEVICE

BACKGROUND OF THE INVENTION

1. Field of the Invention

The present invention relates to an electronic device, and more particularly, to a foldable electronic device.

2. Description of the Prior Art

With rapid development in digital technologies, all kinds of portable and moveable electronic devices play more and more important roles in people's lives. Nowadays all kinds of electronic devices pursuit not only short, light characteristics but also metal appearance designing, and thus it is a common goal to design a foldable electronic device which is portable and has a metal housing. One most obvious example is an all-metal superstructure ultrabook in the conventional market.

The antenna of a conventional foldable electronic device is mostly deployed at the edge of the superstructure of the folding electronic device. However, in the foldable electronic device with all-metal superstructure, due to shielding effect generated by the metal superstructure, power of electromagnetic waves is attenuated and antenna efficiency decreases. Therefore, the conventional antenna configuration method is not easy to be realized. Besides, since the space of the foldable electronic device is limited for pursuing light and thin, antennas more than or equal to 2 with various functions are not easy to be disposed in for transmitting or receiving signals of various communication systems, such as local area network (LAN) and mobile communication system.

Therefore, in order to further develop the foldable electronic device, the aforementioned problems need to be improved or resolved.

SUMMARY OF THE INVENTION

It is therefore an objective of the present invention to provide a foldable electronic device capable of disposing up to at least one antenna set, in which the at least one antenna set is used to receive or transmit various signals.

An embodiment of the present invention discloses a foldable electronic device includes a flat panel display, a base and at least one antenna set. The flat panel display has a metal housing. The base has a pivot side, and the metal housing is pivoted to the pivot side. The antenna set is disposed in the base, and each antenna set has a main antenna and at least one auxiliary antenna, in which the main antenna and the auxiliary antenna are staggered.

The embodiment of the present invention further discloses that at least one antenna set has a first antenna set and a second antenna set, in which the first and the second antenna sets are used to receive or transmit signals of various communication systems.

Another embodiment of the present invention discloses a base which further includes a first and a second carrier and a slot, wherein the slot is located at the pivot side of the base, the first and the second carriers separately disposed in the slot, the first carrier more nearing to the pivot side than the second carrier, and the main and the auxiliary antennas of the first and the second antenna sets are staggered and disposed on the first and the second carriers.

Further another embodiment of the present invention discloses that main antennas of a first and a second antenna set are disposed on a first side of a base, and auxiliary antennas of the first and the second antenna sets are disposed on a second side of the base; wherein the first and the second sides are neighbor to the pivot side, and the first and the second sides are opposite to each other.

Further another embodiment of the present invention discloses a base which further includes a carrier and a slot, wherein the slot is located at the pivot side of the base, the carrier disposed in the slot having a first and a second plane opposite to each other, and the main and the auxiliary antennas of the first and the second antenna sets are staggered and disposed on the first and the second planes of the carrier.

These and other objectives of the present invention will no doubt become obvious to those of ordinary skill in the art after reading the following detailed description of the preferred embodiment that is illustrated in the various figures and drawings.

DETAILED DESCRIPTION

The followings interpret the concept of the present invention according to the figures and detailed description. Those skilled in the art may make alterations or modifications according to the concept of the present invention. Such alterations and modifications shall be within the spirit and scope of the present invention.

A foldable electronic device disclosed in the embodiments of the present invention is to dispose at least one or two antenna sets in a base due to the limitations of all-metal superstructure and maintain the performance of the antenna sets by setting or arrangement method of the antenna sets.

Figure 1A:
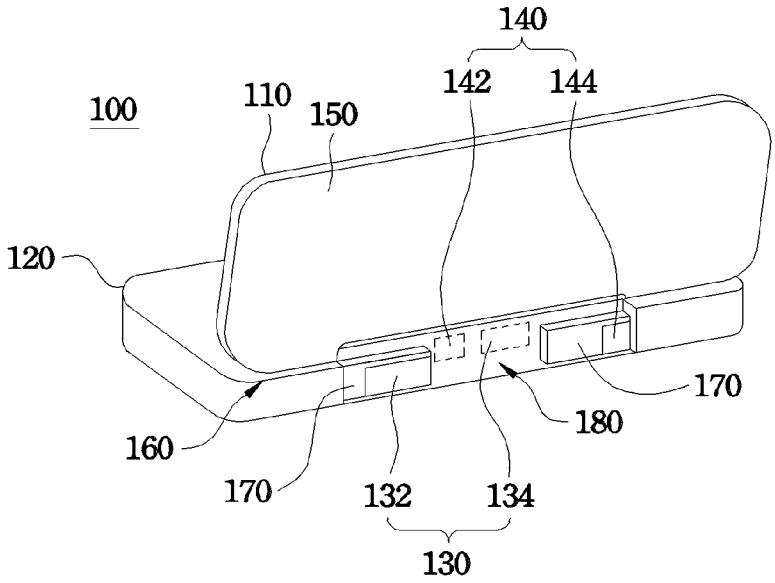
FIG. 1A is a back-view diagram of a foldable electronic device according to a first embodiment of the present invention.
Figure 1B:
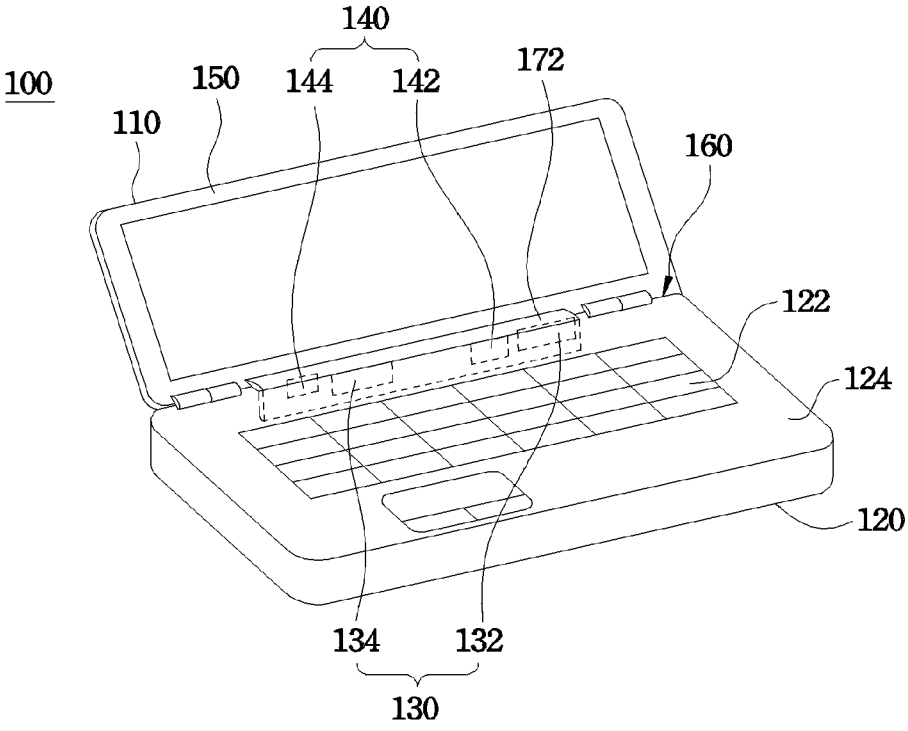
FIG. 1B is a front-view diagram of the foldable electronic device shown in FIG. 1A.

FIGS. 1A-1B are schematic diagrams of different views of a foldable electronic device 100 according to a first embodiment of the present invention. As shown in FIGS. 1A-1B, the foldable electronic device 100 includes a flat panel display 110, a base 120, a first antenna set 130 and a second antenna set 140. The flat panel display 110 has a metal housing 150, which can be a metal superstructure having shape design and protection function. The base 120 has a pivot side 160 pivoted to the metal housing 150, for the metal housing 150 to be the metal superstructure of the flat panel display 110. The first antenna set 130 includes a main antenna 132 and an auxiliary antenna 134, and the second antenna set 140 includes a main antenna 142 and an auxiliary antenna 144, where the main and the auxiliary antennas 132, 134 of the first antenna set 130 are staggered; that is, the main and the auxiliary antennas 132, 134 are disposed on different planes, and the main and the auxiliary antennas 142, 144 of the second antenna set 140 are staggered as well. Note that, the above description with the antenna sets 130, 140 and the main and the auxiliary antennas 132, 134, 142, 144 of the antenna sets 130, 140 are examples according to the present invention. In practice, the number of the antenna sets is not limited to two, and each antenna set may include at least one auxiliary antenna.

The first and the second antenna sets 130, 140 are separately used to receive or transmit signals of various communication systems, such as wideband code division multiple access (WCDMA), global system for mobile communications (GSM), high speed downlink packet access (HSDPA), WiFi, etc. In the first embodiment, the first antenna set 130 can be a wireless local area network (WLAN) antenna supporting communication protocols such as 802.11a, 802.11b, 802.11g, etc., while the second antenna set 140 can be a mobile communication network antenna supporting communication systems using WCDMA and HSDPA.

The main and the auxiliary antennas 132, 134, 142, 144 of the first and the second antenna sets 130, 140 may be coupling antennas, planar inverted-F antennas, etc., which may be composed of common iron, copper foil, laser direct structuring (LDS) or coating conductive liquid and/or paint combined with via technology.

Figure 1C:
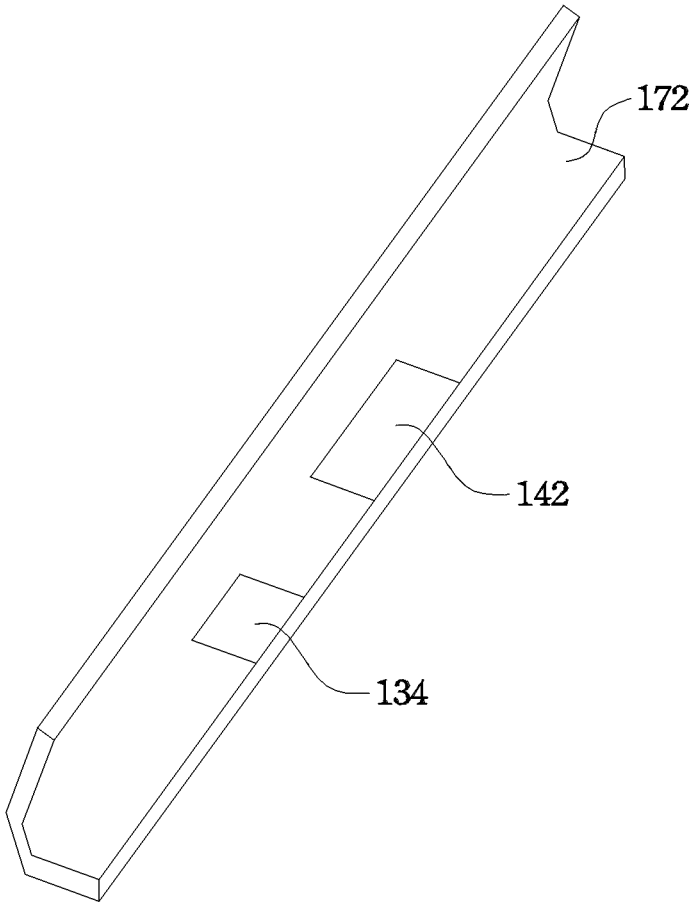
FIG. 1C is another view diagram of a second carrier shown in FIG. 1B.

In the first embodiment, the base 120 further includes a first carrier 170, a second carrier 172 and a slot 180. The slot 180 is located at a pivot side 160 of the base 120, and the first carrier 170 and the second carrier 172 are separately disposed in the slot 180. The first carrier 170 is more nearing to the pivot side 160 than the second carrier 172, i.e. the first carrier 170 is more away from the center of the base 120 than the second carrier 172. The first and the second carriers 170, 172 are used to stagger and carry the main and the auxiliary antennas 132, 134, 142, 144 of the first and the second antenna sets 130, 140, and the types and the positions of disposition of the first and the second carriers 170, 172 can be adjusted according to requirements. For example, the first carrier 170 can be two sheets disposed in the slot 180 and substantially parallel to the pivot side 160, and the second carrier 172 can be an L-type long board (as shown in FIG. 1C) disposed in the slot 180 and more nearing to the inside of the base 120 than the first carrier 170.

Since the main and the auxiliary antennas of the same antenna set are used to receive or transmit signals in the same frequency band, the main and the auxiliary antennas of the same antenna set can be disposed on different carriers or planes, to avoid interfering with each other. As shown in FIGS. 1A-1C, the main antenna 132 of the first antenna set 130 and the auxiliary antenna 144 of the second antenna set 140 are disposed on the first carrier 170, the auxiliary antenna 134 of the first antenna set 130 and the main antenna 142 of the second antenna set 140 disposed on the second carrier 172, and the main and the auxiliary antennas 132, 134, 142, 144 of the first and the second antenna sets 130, 140 disposed on the first and the second carriers 170, 172 are disposed in the same direction. Note that, the above description and the disposition method for the main and the auxiliary antennas 132, 134, 142, 144 of the first and the second antenna sets 130, 140 shown in FIGS. 1A-1C are only examples of the present invention. Without departing from the spirit that the main and the auxiliary antennas of the same antenna set are disposed on different carriers or planes, the disposition method for the main and auxiliary antennas 132, 134, 142, 144 of the first and the second antenna sets 130, 140 is not limited to the first embodiment. In other words, the disposition method can further be one of the followings: the main antennas 132, 142 of the first and the second antenna sets 130, 140 are disposed on the first carrier 170, and the auxiliary antennas 134, 144 of the first and the second antenna sets 130, 140 are disposed on the second carrier 172; the main antenna 132 of the first antenna set 130 and the auxiliary antenna 144 of the second antenna set 140 are disposed on the second carrier 172, and the auxiliary antenna 134 of the first antenna set 130 and the main antenna 142 of the second antenna set 140 are disposed on the first carrier 170; or the main antennas 132, 142 of the first and the second antenna sets 130, 140 are disposed on the second carrier 172, and the auxiliary antennas 134, 144 of the first and the second antenna sets 130, 140 are disposed on the first carrier 170.

The same antenna set is used to receive or transmit signals of the same communication system, and thus tends to interfere with each other in the same frequency band. For example, the first antenna set 130 can support UMT-2100 system, and the auxiliary antenna 134 of the first antenna set 130 may be interfered with transmission signals when the main antenna 132 of the first antenna set 130 transmits the transmission signals at the operating frequency band 1710-2170 MHz of the communication system, causing decrease of receiving efficiency in the operating frequency band. However, by utilizing the method described in the first embodiment, the main and the auxiliary antennas interfere with each other using the same operating frequency band can be reduced by staggering the main antenna 132 and the auxiliary antenna 134 of the first antenna set 130 on different planes and as far away from each other as possible and staggering the main antenna 142 and the auxiliary antenna 144 of the second antenna set 140 on different planes and as far away from each other as possible as well.

In the first embodiment, the base 120 has a keyboard 122 and a host 124, where the keyboard 122 is disposed on the host 124.

Figure 1D:
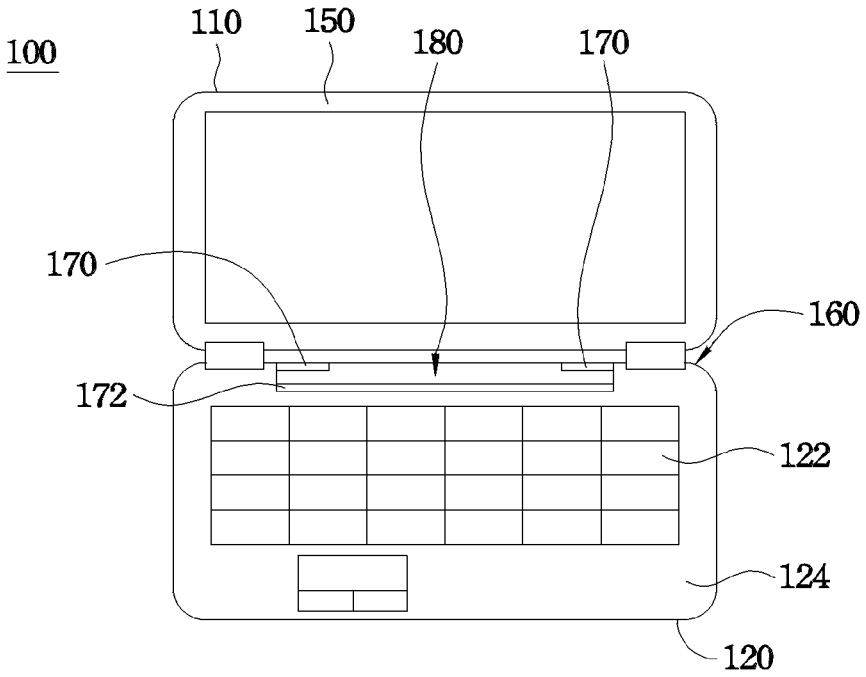
FIG. 1D is a plan-view diagram of the foldable electronic device according to the first embodiment of the present invention.

FIG. 1D is a plane-view diagram according to the first embodiment of the present invention. As shown in FIG. 1D, the first and the second carriers 170, 172 are disposed in the slot 180, and the second carrier 172 is more nearing to the inside of the base 120 than the first carrier 170, i.e. the second carrier 172 is more nearing to the keyboard 122.

Figure 1E:
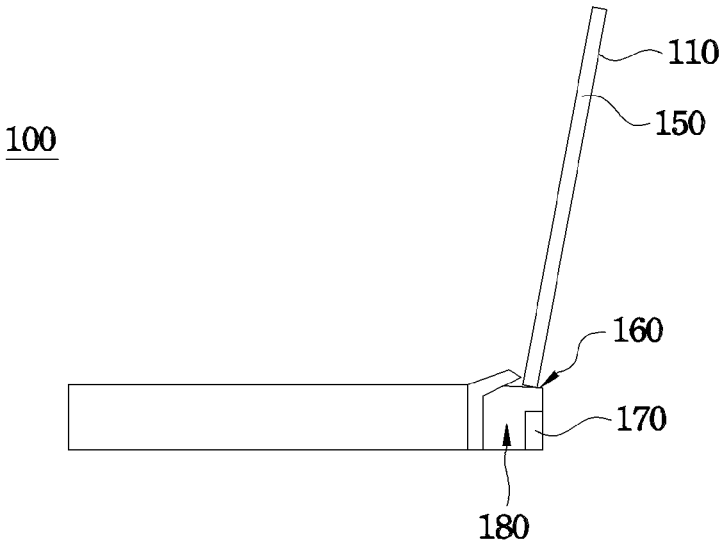
FIG. 1E is a side-view diagram of the foldable electronic device according to the first embodiment of the present invention.

FIG. 1E is a side-view diagram according to the first embodiment of the present invention. As shown in FIG. 1E, the flat panel display 110 is pivoted to the pivot side 160 of the base 120. When the flat panel display device 110 stands or is lifted up, the metal shell 150 can be a barrier shielding, such that the signal interferences between the antennas of the first and the second carriers 170, 172 are reduced.

As mentioned above, in the first embodiment, the main and the auxiliary antennas 132, 134, 142, 144 of the first and the second antenna sets 130, 140 are staggered and disposed by utilizing the first and the second carriers 170, 172, and metal shielding effect is increased by utilizing the metal housing 150, to respectively reduce and block the interferences between the antennas on different carriers, such that the first and the second antenna sets can effectively receive or transmit signals.

Figure 2A:
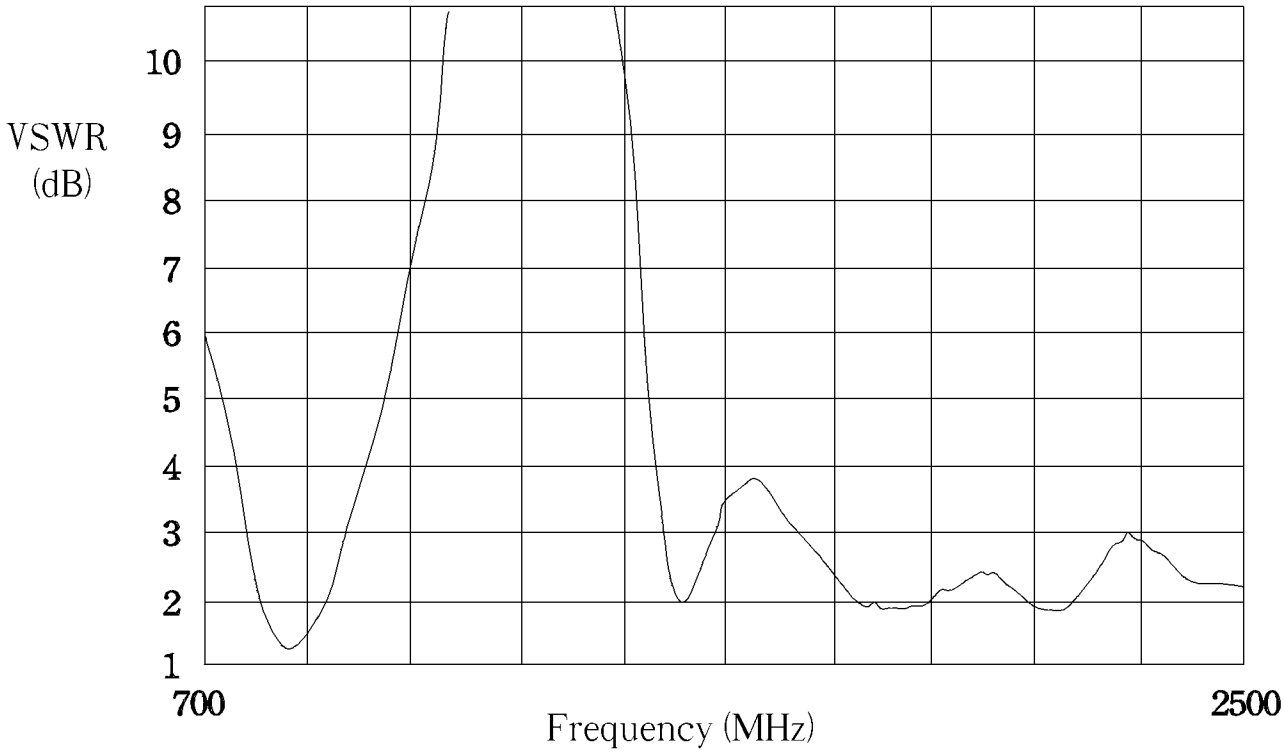
FIG. 2A is a schematic diagram of voltage standing wave ratio (VSWR) of a main antenna of a first antenna set according to the first embodiment of the present invention.

FIG. 2A is a schematic diagram of voltage standing wave ratio (VSWR) of the main antenna 132 of the first antenna set 130 according to the first embodiment of the present invention. In the above embodiment, the antenna efficiency of the main antenna 132 of the first antenna set 130 can be represented via other VSWR and an antenna efficiency table, such as FIG. 2A and Table 1.

TABLE 1

| Frequency (MHz) | Efficiency (%/dB) | | Frequency (MHz) | Efficiency (%/dB) | |
|---|---|---|---|---|---|
| 704 | NA | NA | 1710 | 40.49 | −3.93 |
| 734 | NA | NA | 1750 | 41.35 | −3.84 |
| 740 | NA | NA | 1785 | 46.37 | −3.34 |
| 746 | NA | NA | 1805 | 47.18 | −3.26 |
| 751 | NA | NA | 1840 | 49.80 | −3.03 |
| 756 | NA | NA | 1850 | 48.67 | −3.13 |
| 777 | NA | NA | 1880 | 49.86 | −3.02 |
| 782 | NA | NA | 1910 | 48.90 | −3.11 |
| 787 | NA | NA | 1920 | 47.90 | −3.20 |
| 824 | 46.69 | −3.31 | 1930 | 48.02 | −3.19 |
| 836 | 45.38 | −3.43 | 1950 | 46.10 | −3.36 |
| 849 | 48.07 | −3.18 | 1960 | 45.96 | −3.38 |
| 869 | 50.81 | −2.94 | 1980 | 44.30 | −3.54 |
| 880 | 53.77 | −2.69 | 1990 | 43.32 | −3.63 |
| 894 | 55.25 | −2.58 | 2110 | 38.31 | −4.17 |
| 900 | 52.41 | −2.81 | 2140 | 41.25 | −3.85 |
| 915 | 49.63 | −3.04 | 2170 | 41.39 | −3.83 |
| 925 | 45.42 | −3.43 | | | |
| 940 | 43.52 | −3.61 | | | |
| 960 | 42.22 | −3.74 | | | |

Figure 2B:
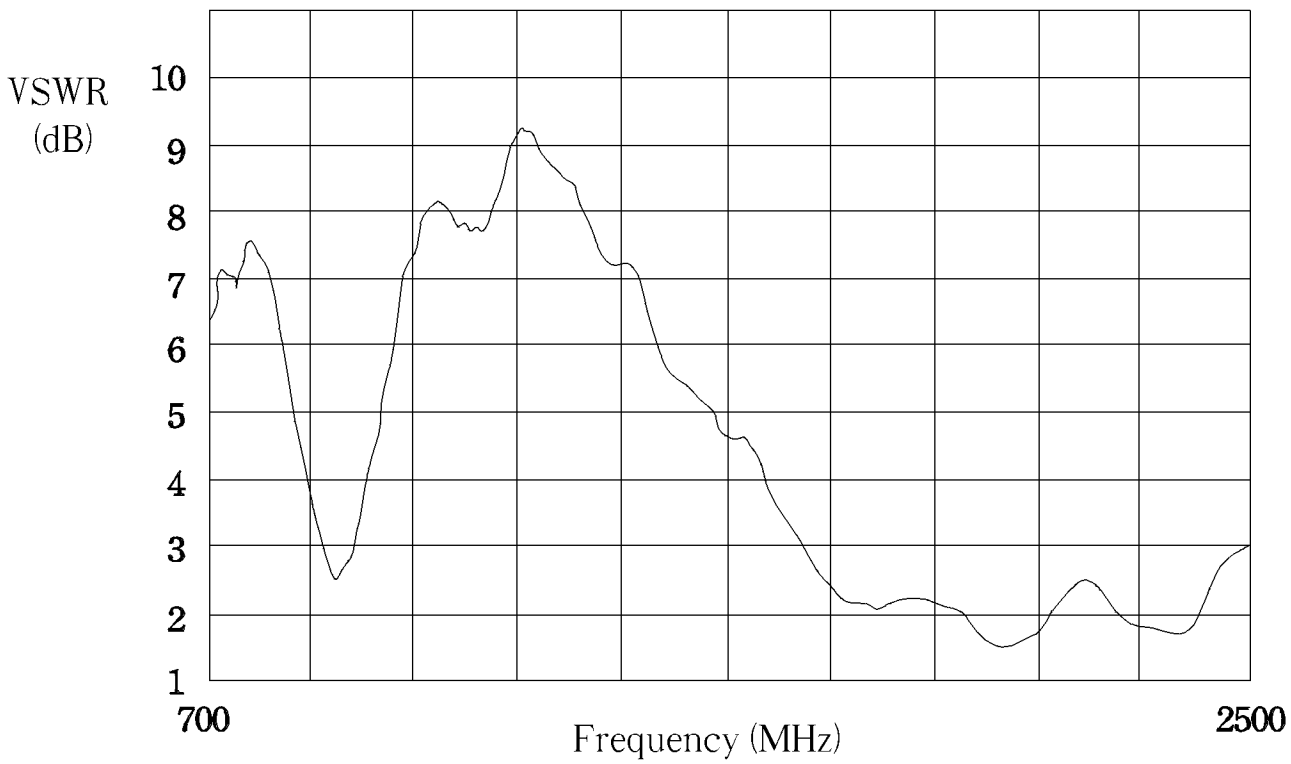
FIG. 2B is a schematic diagram of VSWR of an auxiliary antenna of the first antenna set according to the first embodiment of the present invention.

FIG. 2B is a schematic diagram of VSWR of the auxiliary antenna 134 of the first antenna set 130 according to the first embodiment of the present invention. The antenna efficiency of the auxiliary antenna 134 of the first antenna set 130 is shown in FIG. 2B and Table 2.

TABLE 2

| Frequency (MHz) | Efficiency (%)/dB | | Frequency (MHz) | Efficiency (%/dB) | |
|---|---|---|---|---|---|
| 704 | NA | NA | 1710 | 14.86 | −8.28 |
| 734 | NA | NA | 1750 | 15.75 | −8.03 |
| 740 | NA | NA | 1785 | 18.56 | −7.31 |
| 746 | NA | NA | 1805 | 19.44 | −7.11 |
| 751 | NA | NA | 1840 | 21.24 | −6.73 |
| 756 | NA | NA | 1850 | 21.88 | −6.60 |
| 777 | NA | NA | 1880 | 23.33 | −6.32 |
| 782 | NA | NA | 1910 | 24.92 | −6.03 |
| 787 | NA | NA | 1920 | 25.39 | −5.95 |
| 824 | 16.93 | −7.71 | 1930 | 25.45 | −5.94 |
| 836 | 17.04 | −7.69 | 1950 | 25.73 | −5.90 |
| 849 | 17.76 | −7.50 | 1960 | 25.70 | −5.90 |
| 869 | 18.71 | −7.28 | 1980 | 25.60 | −5.92 |
| 880 | 21.60 | −6.65 | 1990 | 25.19 | −5.99 |
| 894 | 25.16 | −5.99 | 2110 | 26.99 | −5.69 |
| 900 | 25.55 | −5.93 | 2140 | 23.72 | −6.25 |
| 915 | 28.59 | −5.44 | 2170 | 21.57 | −6.66 |
| 925 | 31.01 | −5.09 | | | |
| 940 | 29.97 | −5.23 | | | |
| 960 | 26.15 | −5.82 | | | |

Taking WCDMA utilizing UMTS-2100 system for example, of which the operating frequency band is 1710-2170 MHz. Therefore, as shown in Table 1, Table 2, FIG. 2A and FIG. 2B, the main and the auxiliary antennas 132, 134 of the first antenna set 130 can maintain antenna radiation efficiency in such frequency band.

Figure 2C:
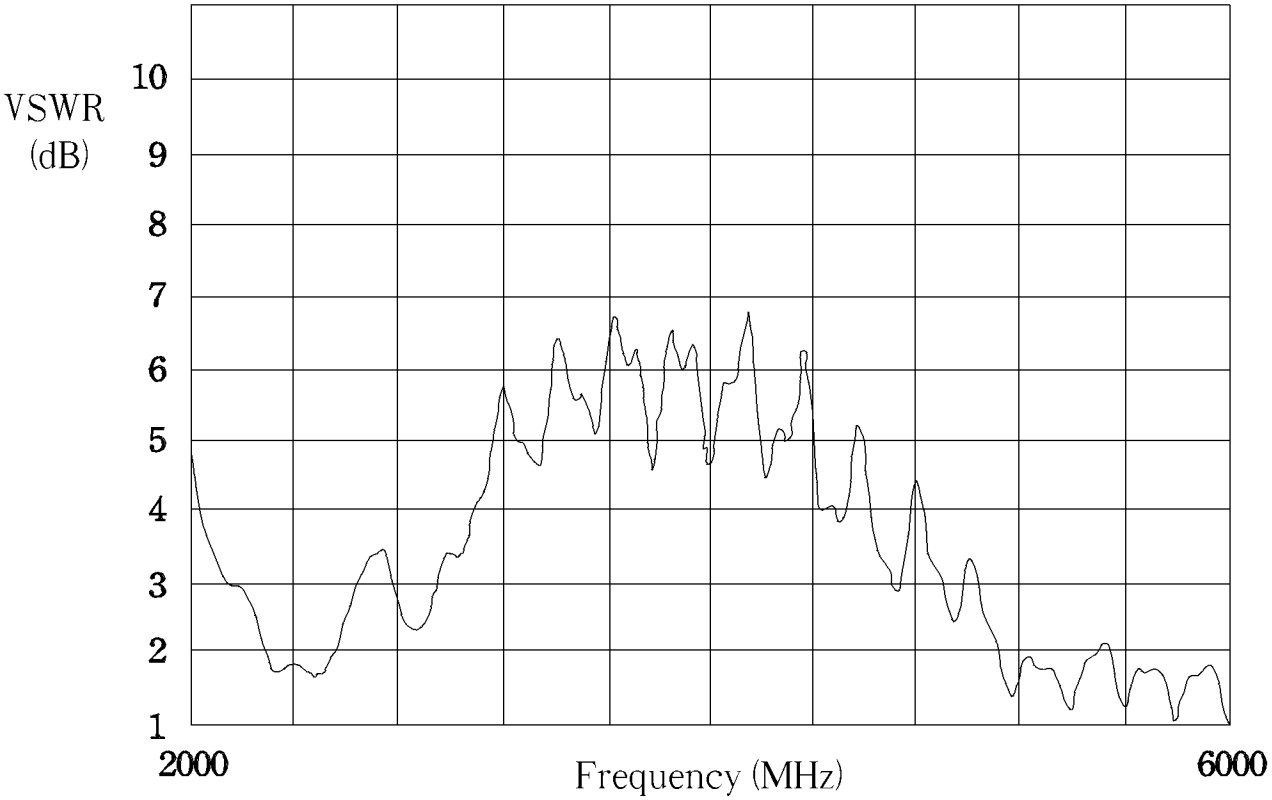
FIG. 2C is a schematic diagram of VSWR of a main antenna of a second antenna set according to the first embodiment of the present invention.

FIG. 2C is a schematic diagram of VSWR of the main antenna 142 of the second antenna set 140 according to the first embodiment of the present invention. The antenna efficiency of the main antenna 142 of the second antenna set 140 is shown in FIG. 2C and Table 3.

TABLE 3

| Frequency (MHz) | Maximum gain of flat panel (dBi) | Average gain of flat panel (dBi) | Efficiency (%)/dB | |
|---|---|---|---|---|
| 2400 | −2.41 | −6.85 | 36.22 | −4.41 |
| 2450 | −1.58 | −6.92 | 38.35 | −4.16 |
| 2500 | −0.18 | −6.86 | 39.47 | −4.04 |
| 5150 | 0.66 | −5.71 | 35.60 | −4.49 |
| 5250 | 1.04 | −5.14 | 40.41 | −3.94 |
| 5350 | 0.19 | −4.86 | 38.44 | −4.15 |
| 5470 | −0.75 | −5.10 | 35.69 | −4.48 |
| 5600 | −0.45 | −4.80 | 39.00 | −4.09 |
| 5725 | −0.27 | −5.65 | 33.61 | −4.74 |
| 5850 | 1.42 | −4.60 | 44.24 | −3.54 |

Figure 2D:
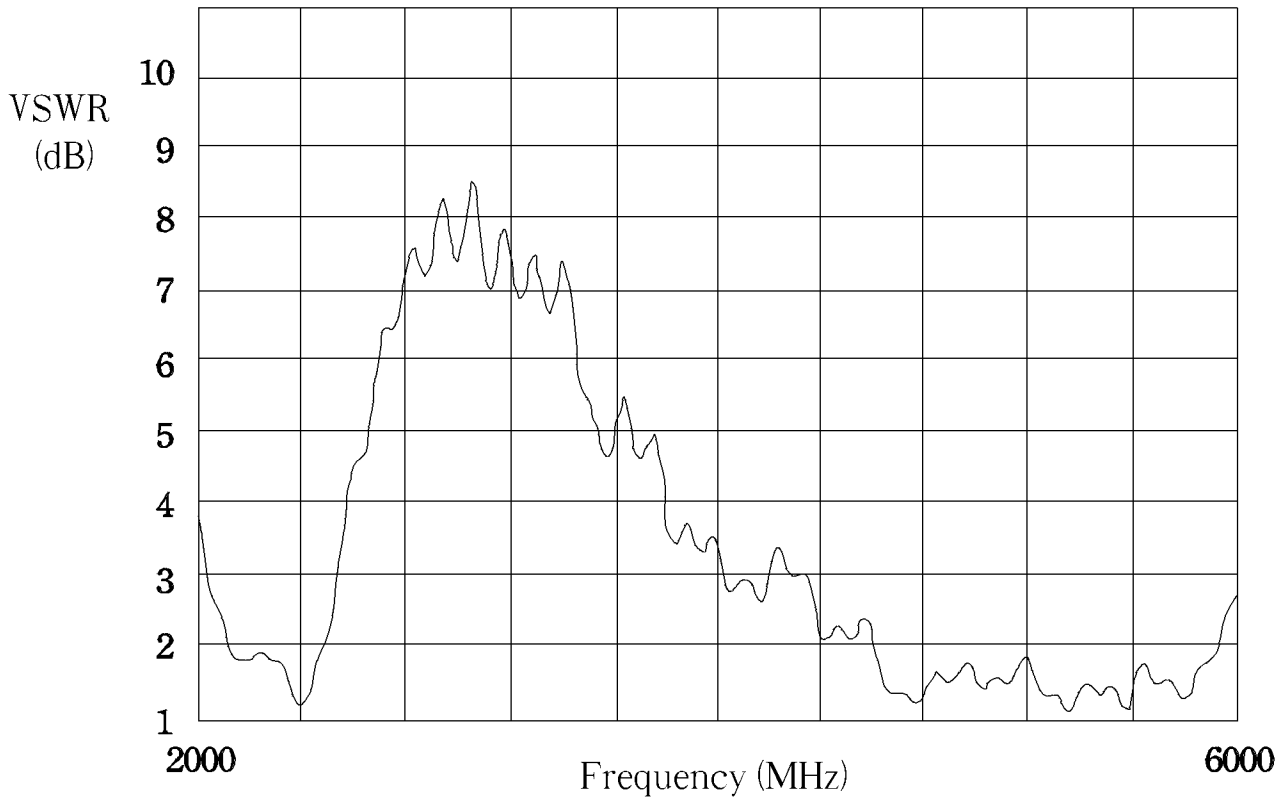
FIG. 2D is a schematic diagram of VSWR of an auxiliary antenna of the second antenna set according to the first embodiment of the present invention.

FIG. 2D is a schematic diagram of VSWR of the auxiliary antenna 144 of the second antenna set 140 according to an embodiment of the present invention. The antenna efficiency of the auxiliary antenna 144 of the second antenna set 140 is shown in FIG. 2D and Table 4.

TABLE 4

| Frequency (MHz) | Maximum gain of flat panel (dBi) | Average gain of flat panel (dBi) | Efficiency (%)/dB | |
|---|---|---|---|---|
| 2400 | −0.48 | −7.10 | 30.69 | −5.13 |
| 2450 | −1.33 | −6.95 | 32.46 | −4.89 |
| 2500 | −3.40 | −8.60 | 27.85 | −5.55 |
| 5150 | 1.52 | −5.62 | 46.36 | −3.34 |
| 5250 | 0.83 | −5.96 | 48.40 | −3.15 |
| 5350 | 0.49 | −5.23 | 48.76 | −3.12 |
| 5470 | 2.28 | −4.14 | 52.15 | −2.83 |
| 5600 | 2.73 | −4.07 | 50.60 | −2.96 |
| 5725 | 1.54 | −5.37 | 48.30 | −3.16 |
| 5850 | 2.89 | −3.67 | 53.56 | −2.71 |

In a WLAN environment, the operating frequency band of the communication protocol 802.11a is 5150-5850 MHz, while the operating frequency band of the communication protocols 802.11b and 802.11g is 2400-2483.5 MHz. Therefore, as shown in Table 3, Table 4, FIG. 2C and FIG. 2D, the main and the auxiliary antennas 142, 144 of the second antenna set 140 can maintain the antenna radiation efficiency in such frequency band.

Figure 3:
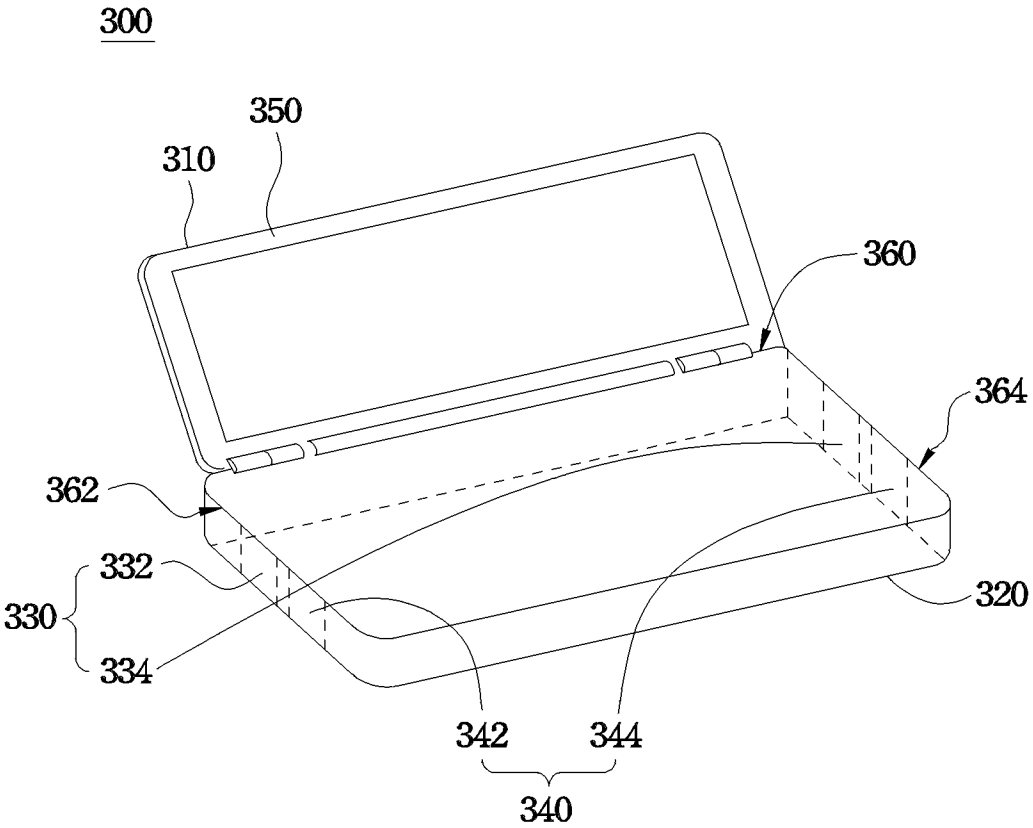
FIG. 3 is a schematic diagram of a foldable electronic device according to a second embodiment of the present invention.

FIG. 3 is a schematic diagram of a foldable electronic device 300 according to a second embodiment of the present invention. As shown in FIG. 3, the foldable electronic device 300 includes a flat panel display 310, a base 320, a first antenna set 330 and a second antenna set 340. The flat panel display 310 has a metal housing 350. The base 320 has a pivot side 360 pivoted to the metal housing 350. The first antenna set 330 includes a main antenna 332 and an auxiliary antenna 334, and the second antenna set 340 includes a main antenna 342 and an auxiliary antenna 344.

In the second embodiment, the base 320 further has a first side 362 and a second side 364. The first and the second sides 362, 364 are neighbor to the pivot side 360, and the first and the second sides 362, 364 are opposite to each other. As mentioned above, the interference between the main and the auxiliary antennas of the same antenna set can be reduced by disposing the main and the auxiliary antennas of the same antenna set on different planes. Therefore, in the second embodiment, the main antennas 332, 342 of the first and the second antenna sets 330, 340 can be disposed on the first side 362 of the base 320, and the auxiliary antennas 334, 344 of the first and the second antenna sets 330, 340 can be disposed on the second side 364 of the base 320. Similarly, the disposition method, of which the main antenna 332 of the first antenna set 330 and the auxiliary antenna 344 of the second antenna set 340 can be disposed on the first side 362 of the base 320, and the auxiliary antenna 334 of the first antenna set 330 and the main antenna 342 of the second antenna set 340 can be disposed on the second side 364 of the base 320, can be derived according to the spirit of aforementioned disposing the main and the auxiliary antennas of the same antenna set on different planes. Note that, the first side 362 mentioned above can be any side neighbor to the pivot side 360, which is not limited to that shown in FIG. 3, and the second side 364 and the first side 362 are opposite to each other.

Besides, in the second embodiment, since the flat panel display 310, which is lifted up or stands, is not between the main and the auxiliary antennas 332, 334 of the first antenna set 330 and the main and the auxiliary antennas 342, 344 of the second antenna set 340, the position of the metal housing 350 of the flat panel display 310 does not affect antenna performance.

Figure 4:
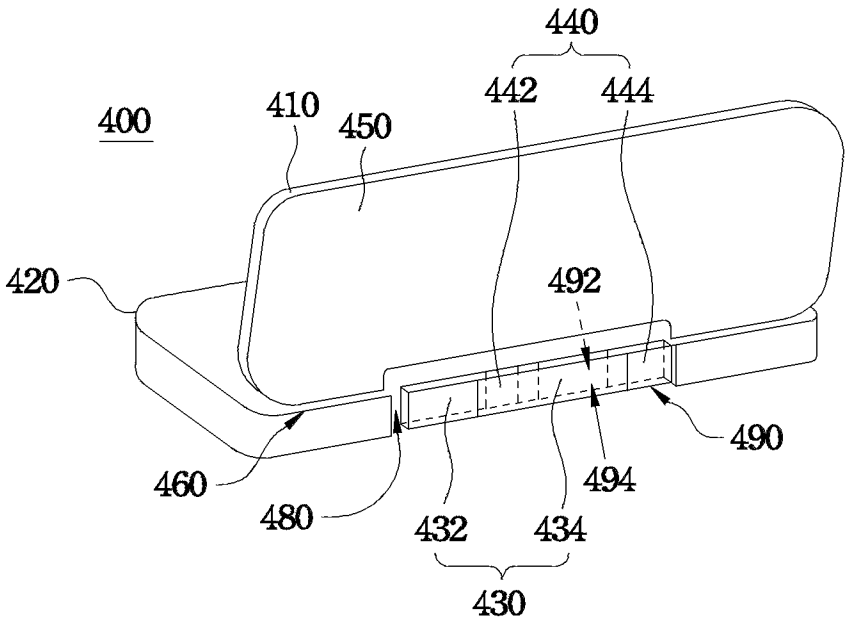
FIG. 4 is a schematic diagram of a foldable electronic device according to a third embodiment of the present invention.

FIG. 4 is a schematic diagram of a foldable electronic device 400 according to a third embodiment of the present invention. The foldable electronic device 400 includes a flat panel display 410, a base 420, a first antenna set 430 and a second antenna set 440. The flat panel display 410 has a metal housing 450. The base 420 has a pivot side 460 pivoted to the metal housing 450. The first antenna set 430 includes a main antenna 432 and an auxiliary antenna 434, and the second antenna set 440 includes a main antenna 442 and an auxiliary antenna 444.

In the third embodiment, the base 420 includes a slot 480 and a carrier 490. The carrier 490 is located in the slot 480, which has a first plane 492 and a second plane 494 opposite to each other, and the slot 480 is located at the pivot side 460 of the base 420. As mentioned above, the interference between the main and the auxiliary antennas of the same antenna set can be reduced by disposing the main and the auxiliary antennas of the same antenna set on different planes. Therefore, in the third embodiment, the main antennas 432, 442 of the first and the second antenna sets 430, 440 can be disposed on the first plane 492, and the auxiliary antennas 434, 444 of the first and the second antenna sets 430, 440 can be disposed on the second plane 494. Similarly, the disposition method, of which the main antenna 432 of the first antenna set 430 and the auxiliary antenna 444 of the second antenna set 440 can be disposed on the first plane 492, and the auxiliary antenna 434 of the first antenna set 430 and the main antenna 442 of the second antenna set 440 can be disposed on the second plane 494, can be derived according to the spirit of aforementioned disposing the main and the auxiliary antennas of the same antenna set on different planes. Note that, the first plane 492 mentioned above can be a plane of the carrier 490 more nearing to or far away from the center of the base 420, and the second plane 494 and the first plane 492 are opposite to each other. In the present embodiment, the carrier 490 is a flat panel carrier. Besides, the carrier 490 is not limited to the appearance shown in FIG. 4, and can be designed according to practical requirements.

Similarly, in the third embodiment, if the flat panel display 410, which is lifted up or stands, is not between the main and the auxiliary antennas 432, 434 of the first antenna set 430 and the main and the auxiliary antennas 442, 444 of the second antenna set 440, the position of the metal housing 450 of the flat panel display 410 does not affect the antenna performance. Otherwise, the metal housing 450 can be used as metal shielding for reducing the interference between the main and the auxiliary antennas 432, 434 or 442, 444 of the same antenna set.

To sum up, by applying the technology characteristics of the present invention that the antennas are disposed on the base of the foldable electronic device, not only the problem of poor antenna performance caused by disposing the antennas on the metal superstructure can be improved but also the space of the base for disposing at least two antenna sets for simultaneously receiving signals of the various communication systems is properly used. Besides, by using the disposition method of the main and the auxiliary antennas staggered and disposed on different planes, the interference between the main and the auxiliary antennas of the same antenna set can be further reduced and the antenna efficiency can be maintained, so as to enhance the communication capacity of the foldable electronic device.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A foldable electronic device, comprising:

a flat panel display having a metal housing;

a base having a pivot side pivoted to the metal housing; and at least one antenna set disposed in the base, each antenna set having a main antenna and at least one auxiliary antenna, in which the main antenna and the auxiliary antenna are staggered;

wherein the at least one antenna set has a first antenna set and a second antenna set, in which the first and the second antenna sets are used to receive or transmit signals of various communication systems;

wherein the base further comprises a first carrier and a second carrier and a slot, in which the slot is located at the pivot side of the base, the first and the second carriers separately disposed in the slot, the first carrier more nearing to the pivot side than the second carrier, and the main and the auxiliary antennas of the first and the second antenna sets are staggered and disposed on the first and the second carriers.

2. The foldable electronic device of claim 1, wherein the first antenna set is a wireless local area network (WLAN) antenna, and the second antenna set is a mobile communication antenna.

3. The foldable electronic device of claim 1, wherein the main antenna of the first antenna set and the auxiliary antenna of the second antenna set are disposed on the first carrier, and the auxiliary antenna of the first antenna set and the main antenna of the second antenna set are disposed on the second carrier.

4. The foldable electronic device of claim 1, wherein the main antennas of the first and the second antenna sets are disposed on the first carrier, and the auxiliary antennas of the first and the second antenna sets are disposed on the second carrier.

5. The foldable electronic device of claim 1, wherein the main antenna of the first antenna set and the auxiliary antenna of the second antenna set are disposed on the second carrier, and the auxiliary antenna of the first antenna set and the main antenna of the second antenna set are disposed on the first carrier.

6. The foldable electronic device of claim 1, wherein the main antennas of the first and the second antenna sets are disposed on the second carrier, and the auxiliary antennas of the first and the second antenna sets are disposed on the first carrier.

7. A foldable electronic device, comprising:

a flat panel display having a metal housing;

a base having a pivot side pivoted to the metal housing; and at least one antenna set disposed in the base, each antenna set having a main antenna and at least one auxiliary antenna, in which the main antenna and the auxiliary antenna are staggered;

wherein the at least one antenna set has a first antenna set and a second antenna set, in which the first and the second antenna sets are used to receive or transmit signals of various communication systems;

wherein the main antennas of the first and the second antenna sets are disposed on a first side of the base, and the auxiliary antennas of the first and the second antenna sets are disposed on a second side of the base;

wherein the first and the second sides are neighbor to the pivot side, and the first and the second sides are opposite to each other.

8. A foldable electronic device, comprising:

a flat panel display having a metal housing;

a base having a pivot side pivoted to the metal housing; and at least one antenna set disposed in the base, each antenna set having a main antenna and at least one auxiliary antenna, in which the main antenna and the auxiliary antenna are staggered;

wherein the at least one antenna set has a first antenna set and a second antenna set, in which the first and the second antenna sets are used to receive or transmit signals of various communication systems;

wherein the main antenna of the first antenna set and the auxiliary antenna of the second antenna set are disposed on a first side of the base, and the auxiliary antenna of the first antenna set and the main antenna of the second antenna set are disposed on a second side of the base;

wherein the first and the second sides are neighbor to the pivot side, and the first and the second sides are opposite to each other.

9. A foldable electronic device, comprising:

a flat panel display having a metal housing;

a base having a pivot side pivoted to the metal housing; and at least one antenna set disposed in the base, each antenna set having a main antenna and at least one auxiliary antenna, in which the main antenna and the auxiliary antenna are staggered;

wherein the at least one antenna set has a first antenna set and a second antenna set, in which the first and the second antenna sets are used to receive or transmit signals of various communication systems;

wherein the base further comprises a carrier and a slot, in which the slot is located at the pivot side of the base, the carrier disposed in the slot having a first plane and a second plane opposite to each other, and the main and the auxiliary antennas of the first and the second antenna sets are staggered and disposed on the first and the second planes of the carrier.

10. The foldable electronic device of claim 9, wherein the main antenna of the first antenna set and the auxiliary antenna of the second antenna set are disposed on the first plane of the carrier, and the auxiliary antenna of the first antenna set and the main antenna of the second antenna set are disposed on the second plane of the carrier.

11. The foldable electronic device of claim 9, wherein the main antennas of the first and the second antenna sets are disposed on the first plane of the carrier, and the auxiliary antennas of the first and the second antenna sets are disposed on the second plane of the carrier.

* * * * *